US009475551B1

(12) United States Patent
Stoyanov

(10) Patent No.: US 9,475,551 B1
(45) Date of Patent: Oct. 25, 2016

(54) BUOY ARRESTER

(71) Applicant: Zlatko Stoyanov, Pompano Beach, FL (US)

(72) Inventor: Zlatko Stoyanov, Pompano Beach, FL (US)

( * ) Notice: Subject to any disclaimer, the term of this patent is extended or adjusted under 35 U.S.C. 154(b) by 0 days.

(21) Appl. No.: 14/543,150

(22) Filed: Nov. 17, 2014

Related U.S. Application Data

(60) Provisional application No. 61/962,956, filed on Nov. 20, 2013.

(51) Int. Cl.

| | |
|---|---|
| ***B63B 21/20*** | (2006.01) |
| ***B63B 17/00*** | (2006.01) |
| *B63B 21/00* | (2006.01) |

(52) U.S. Cl.
CPC ..... *B63B 17/00* (2013.01); *B63B 21/20* (2013.01); *B63B 2021/003* (2013.01); *B63B 2021/203* (2013.01)

(58) Field of Classification Search
CPC ..... B63B 21/54
See application file for complete search history.

(56) References Cited

U.S. PATENT DOCUMENTS

| | | | | |
|---|---|---|---|---|
| 1,536,701 | A * | 5/1925 | Buckingham et al. | 114/230.25 |
| 4,595,223 | A | 6/1986 | Hawie | |
| 6,409,240 | B1 | 6/2002 | Ferguson | |
| 7,810,442 | B2 * | 10/2010 | Duarte et al. | 114/230.2 |

* cited by examiner

*Primary Examiner* — Edwin Swinehart

(57) ABSTRACT

A buoy arrester comprising a boat hook body having a U-shaped with parallel sides and a first free end angled away from the U-shaped opening, a line securing ring integrally formed with said boat hook body and positioned at the U-shaped opening and a removable handle that is pole shaped that can be attached to the second free end of said boat hook body. A resilient line retainer catch can be positioned across the boat hook U-shaped opening to prevent the mooring line from detaching from the boat hook body. A securing line is attached to the line securing ring on the boat hook body.

3 Claims, 4 Drawing Sheets

ADAPTOR

PREVENTER

BUOY ARRESTER

CROSS REFERENCE TO RELATED APPLICATIONS

This application claims the benefit of provisional U.S. Patent Application Ser. No. 61/962,956, filed on Nov. 20, 2013.

BACKGROUND OF THE INVENTION

1. Field of the Invention

A buoy arrester that includes a boat hook having a U-shaped body for manually capturing a mooring line in the water by a mariner positioned on a floating vessel, a releasable boat hook pole-shaped handle, and a line attaching ring positioned on the boat hook body at the U-shaped opening for securing the boat hook to the vessel during arrestment of the mooring line.

2. Description of Related Art

A mooring is useful for anchoring a boat in a body of water. A mooring typically has a large concrete block secured on the ocean bottom and a mooring chain or line from the secured block to a float on top of the water to identify its location. The mooring line can be tied to a boat for anchorage. Capturing a mooring line from a moving boat using a boat hook can be very tricky and sometimes dangerous, especially in heavy winds or fast current situations or both. A mariner, especially if alone, will be forced to stand and reach over the side of a moving vessel with a boat hook for capturing the mooring line. Once the mariner has engaged the mooring line in the water with the boat hook, the mariner still must maneuver the mooring line into the boat for attachment to a boat cleat for a secure anchorage. The experience of mooring a boat to a mooring line can result in dropping the boat hook into the ocean after capture or making several passes over the line without line capture.

Using the buoy arrester described herein, mooring a vessel even with a single person is made much easier and safer because of the construction of the buoy arrester. By having the mariner grasp a separate securing line attached at one end directly to the boat hook on a ring adjacent the opening of the boat hook, the mariner can retain control of the boat hook in every situation to prevent loss of the boat hook over the side. Once the mariner captures the mooring line, the mariner can pull the mooring line on to the boat or up to the boat for attachment to a cleat or other line.

SUMMARY OF THE INVENTION

A buoy arrester comprising a rigid boat hook that has a U-shaped body for capturing a mooring line manually, a pole-shaped handle releasably attached at one end to said boat hook body. The handle is used by a mariner to manipulate the position of the boat hook for initial contact and capture of the mooring line from the water while the mariner is standing on the boat or vessel and the vessel is approaching the mooring.

The boat hook body end may include a male connector that can receive and hold the handle end using a tight friction fit that can be separated from the boat hook body end with manual force to release the handle from the boat hook body when desired.

The U-shaped boat hook body also includes a ring disposed near the boat hook U-shaped opening. The boat hook ring is used to attach a boat hook securing line that is held by the mariner who is also manipulating the boat hook pole to capture the mooring line.

Once the boat hook U-shaped body has captured the mooring line, the mariner can disengage and release the pole-shaped handle from the boat hook while retaining the securing line and pulling the boat hook and mooring line toward the mariner with the securing line so that the boat can be cleated directly to the mooring line or to a separate boat cleated line that is firmly attached directly to the mooring line to establish an anchorage. The boat hook securing line will ensure that the boat hook is not lost over the side even after it is detached from the mooring line.

Because the boat hook body ring and the securing line attached to the ring are physically and directly aligned with the opening across the boat hook U-shaped body opening, manual pulling force on the boat hook securing line will ensure a direct line of force along the same axis between the mooring line and the boat hook securing line while pulling the mooring line on board the boat.

To use the buoy arrester described herein in order to capture and secure a mooring line, a person on the boat would use the boat hook with the attached pole shaped handle to manually stand near the edge of the boat and extend the boat hook to the vicinity of the floating buoy which is attached to the mooring line in an effort to capture the mooring line. Once the boat person has captured the mooring line in the boat hook, the pole shaped handle can be removed by pulling on the handle while at the same time the boat person is it holding tightly on to the boat hook securing line.

Pulling on the boat hook securing line by the mariner will pull the boat toward the mooring buoy and also pull the mooring line to the boat. In some moorings there is an extra line attached to the buoy that is used to attach to the boat cleat to establish the anchorage and mooring. Sometimes the mariner will attach a line already cleated to the boat directly to the mooring line for the anchorage. Once the mooring line has been cleated to the boat, the mariner can manually remove the boat hook body from the mooring line. When the mariner is pulling in the mooring line using the boat hook securing line attached to the boat hook ring, the line of direction of force will be directly through the opening and U-shaped portion of the boat hook for improving the efficiency of the capture of the mooring line.

It is an object of this invention to provide a buoy arrester that allows a mariner to safely and quickly capture a mooring line while standing on a vessel to secure an anchorage for the vessel.

It is another object of this invention to provide a buoy arrester that includes a U-shaped boat hook body that includes a line securing ring that is positioned at the opening of the boat hook opening for aligning the direction of force when securing and capturing a mooring line and while pulling on the boat hook securing line by the mariner.

DESCRIPTION OF THE BUOY ARRESTER

The buoy arrester is designed to help a boat operator or mariner quickly secure a vessel to a mooring buoy with one easy motion. The device which is the boat hook is attached at one end to an extendable pole shaped handle 8 feet or longer. A synthetic line of three-quarter inch diameter is secured to the ring on the boat hook at the bitter end, while the other end of the boat securing line is attached to a cleat at the bow of the vessel. The synthetic securing line should be at least 25 feet long. The boat operator holds the extendable handle and the synthetic line together as the vessel approaches the buoy. The boat operator then manually hooks the boat hook to the mooring line that is attached to the buoy and the float. The boat operator then disengages the boat hook body by pulling the handle backwards while leaving the boat line attached to the buoy, moves the vessel closer to the mooring buoy, replaces the synthetic line with a heavy gauge line according to safety regulations for securing a vessel to a mooring buoy. The buoy arrester is not designed to be left permanently attached to the buoy. The buoy arrester is an aiding device that is designed to help a boat operator or mariner initially catch the buoy mooring line and then proceed according to the regulations. The buoy arrester is very useful in a bad weather situation with strong winds, choppy waters and/or a single person handling the vessel for a shorthanded crew.

The body is manufactured from a noncorrosive 316 stainless steel one half inch diameter rod. The female fastener or adapter for attaching the handle to the boat hook body is manufactured out of either aluminum or stainless steel tubing ⅞ inch inside diameter tubing. The purpose is to attach the adapter to the handle in a friction connection so that the handle can be separated from the boat hook body by pulling on the handle once the boat hook body is attached to a mooring line. The adapter fits most commercially available handles on the market with a ⅞ inch outside diameter.

Figure 1:
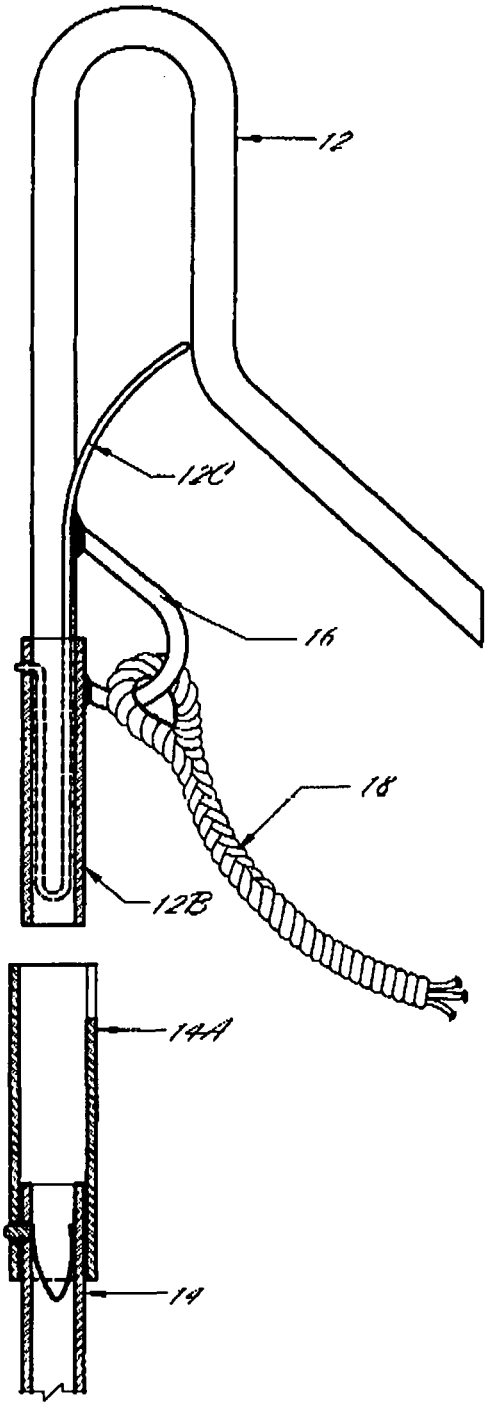
FIG. 1 is a side elevational view of the boat hook body with the pole-shaped handle detached.
Figure 2:
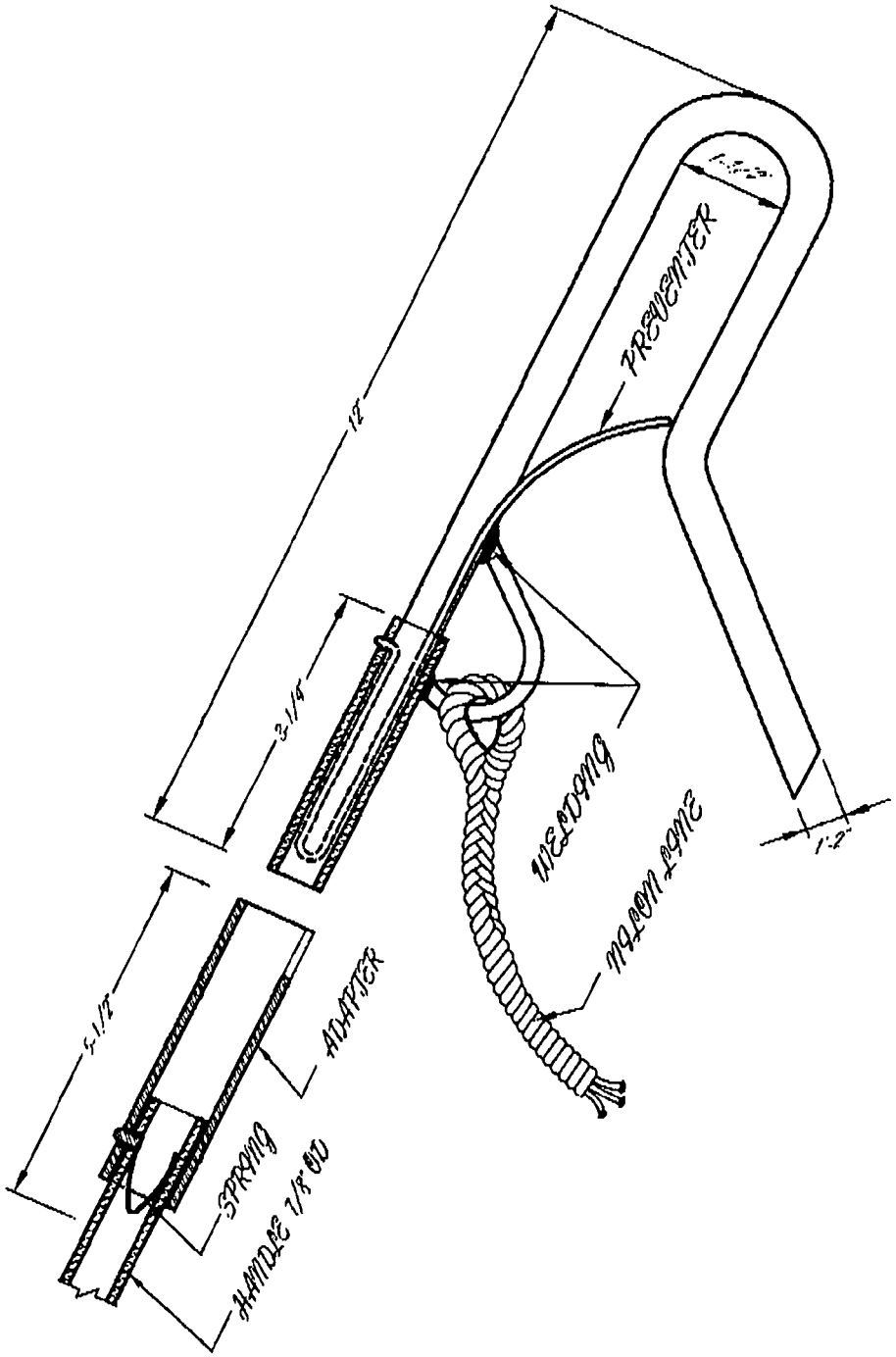
FIG. 2 is a perspective view of the boat hook body shown in FIG. 1.

Referring now to the drawings and in particular FIG. 1 and FIG. 2 a buoy arrester 10 is shown that includes an anchor hook body 12 that includes a first free end 12*a* defining a U-shaped hook opening with parallel sides and a second free end 12*b* that may include a cylindrically shaped male friction fastener end portion that allows the boat hook body 12 to be attached to a pole shaped handle at one end.

The boat hook body 12 may also include a mooring line retainer flexible catch 12*c* near the opening of the U-shaped hook to ensure that the mooring line (once captured) will not be released from the boat hook without manual intervention.

A pole shaped handle 14 includes a cylindrically-shaped female friction fastener adapter 14*a* at one end that is sized in diameter to engage the boat hook female fastener 12*b* to securely hold the boat hook body 12 to the handle 14 when necessary. The cylindrically shaped handle fastener adapter 14*a* may include a slot 14*b* (FIG. 4) at one end which can engage and receive a portion of the boat hook ring 16 described below.

The boat hook body 12 includes a line securing ring 16 integrally formed with the boat hook body 12. The line securing ring 16 is in the same plane as the boat hook U-shaped body and is positioned near the opening of the U-shaped boat hook body to provide alignment along the longitudinal axis of the boat hook body which aids in alignment when pulling in the mooring line with the secure line 18 to the boat hook body 12.

The boat hook body male fastener 12 *b* can be manually attached or removed from the handle friction fastener adapter 14*a* when necessary during a mooring capture especially after the mooring line has been positioned inside the U-shaped boat hook body allowing the handle to be manually disengaged by pulling on the boat hook and the mooring line at the same time. The boat operator will of course have the boat hook securing line firmly in grip which is used to pull on the boat hook once the mooring line is captured while at the same time the boat hook handle is detached from the boat hook body fastener 12*b*.

The free end of the boat hook body 12*a* may be angled at approximately 45 degrees relative to the U-shaped hook body outwardly to increase the opening presented by the hook relative to the capture of a mooring line that increases the length of the effective opening of the boat hook U-shaped body 12 to increase the probability of capturing a mooring line in the water.

Figure 3:
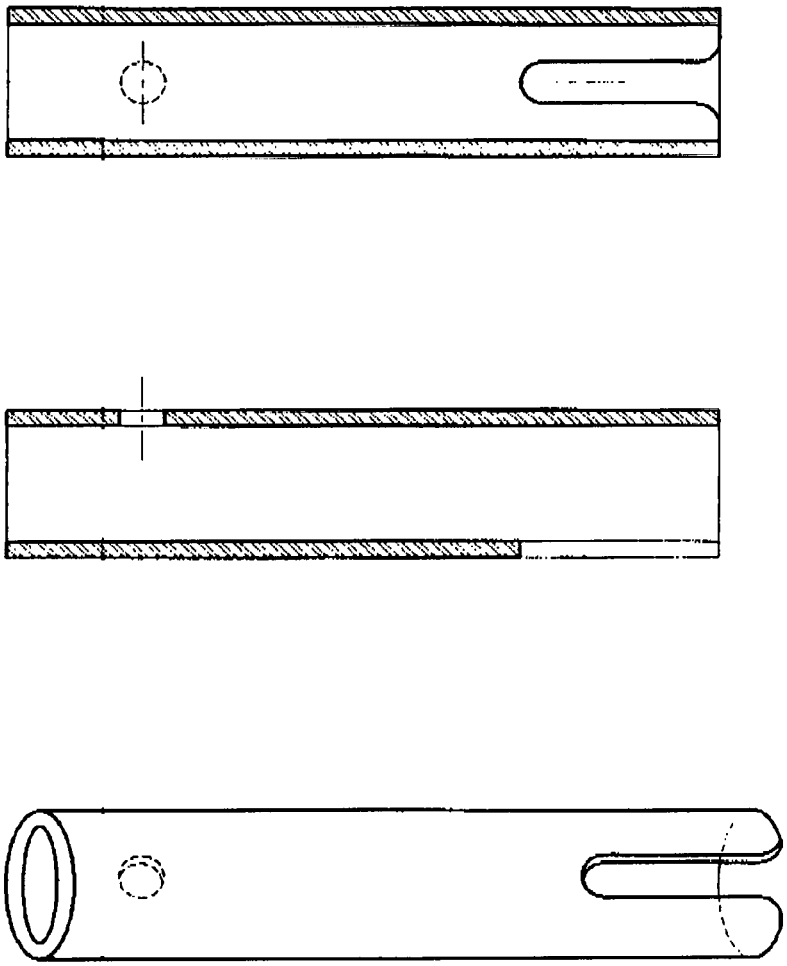
FIG. 3 shows a schematic view of a buoy float attached to a mooring and a mooring line.

FIG. 3 shows a typical mooring in a body of water 26 that includes a large heavy block of material 24 that can be firmly anchored to the ocean bottom 28 and includes a chain or line 22 connected to eye 24*a*. The buoy float 20 is attached to the heavy block 24 by a chain or mooring line 22 through buoy float eye 20*a* and an additional heavy duty mooring line 30 which can be secured to a boat or vessel directly or to a heavy duty line from a boat or vessel.

Figure 4:
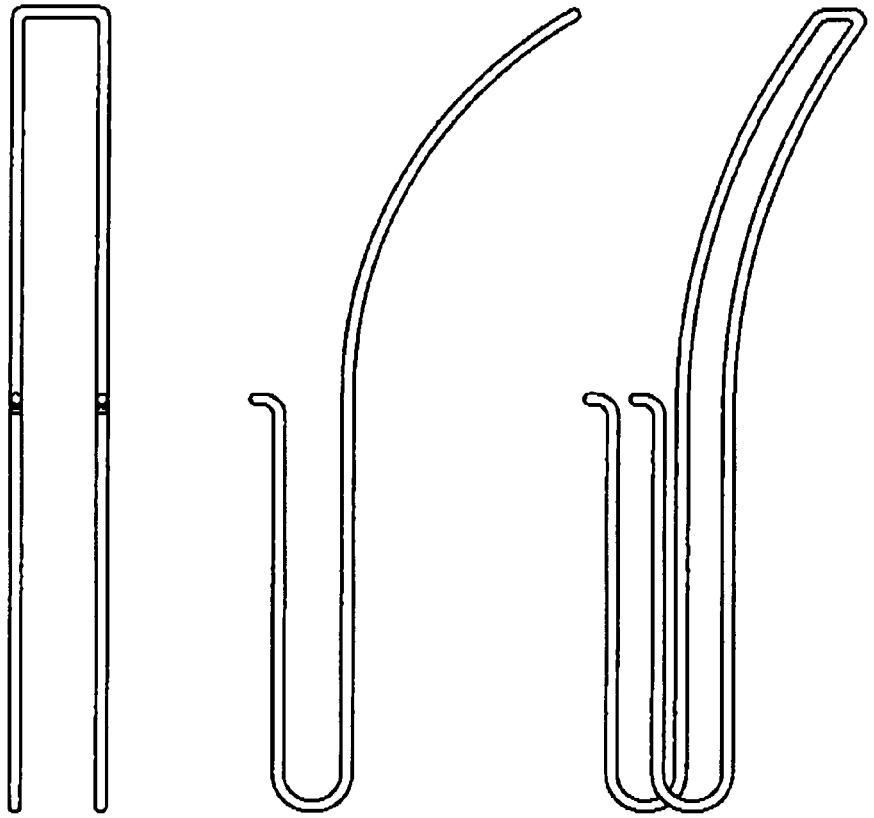
FIG. 4 shows a cutaway view of the male friction attachment fastener on the boat hook separated from the female friction fastener attached to the pole shaped handle in a front elevational view.

FIG. 4 shows how the handle 14 which includes an adapter 14 *a* that is a cylindrical female fastener that includes a slot 14*b* can frictionally engage the boat hook free end male fastener 12*b* with a frictional fit that is slidably releasable. The securing line ring 16 which protrudes outwardly from the boat hook 12 is positioned into the adapter slot 14*b* when the handle is frictionally attached to the boat hook body 12 which prevents the handle 14 from rotating because of slot 14 be engaged to a portion of the ring 16.

Referring back to FIG. 1, the securing line 18 that is tied through the ring 16 on the boat hook body 12 is extremely important for the operation of the device in that the boat hook body 12 will not be lost overboard during the operation because the boat operator will hold or secure the boat hook securing line 18 at all times during the mooring operation. The one end of the securing line 18 may be cleated to the boat or vessel. The boat hook securing line 18 is also used by the boat operator to pull the mooring line up to the side of the boat so that the mooring line can be cleated to the boat to establish the mooring and the anchorage. In another embodiment the boat operator may alternatively attach a line that is secured to the boat cleat directly to the mooring line for a secure attachment and anchorage.

To use the buoy arrester described herein, the boat operator directs the boat to a floating buoy that represents a mooring line and mooring attached thereto for anchorage. As the boat approaches the buoy, the boat operator will have the boat hook body firmly attached to the handle and will stand in a position along the side of the boat to secure the boat hook to the mooring line that is attached to the buoy (which is the mooring line) by manually reaching out with the boat hook into the water to capture the mooring line. The boat operator or mariner also holds the securing line in one hand during this operation that is attached to the boat hook ring. Once the mooring line is captured at the same time, the boat operator holds onto the boat hook securing line. The handle that is attached by friction to the boat hook body can be pulled apart separating the handle from the boat hook. At the same time the boat operator will pull on the securing line directly attached to the ring on the boat hook which pulls on the mooring line pulling the boat to the mooring line and the mooring line to the boat. The boat operator can continue pulling so that the mooring line will be lifted up to the boat which allows the line to be cleated to a cleat on the boat for securing the anchorage. In an alternate embodiment the boat operator could take a separate line that is already cleated to the boat and attach it directly around the mooring line firmly tying the two lines together for the anchorage.

Once the mooring line is safely attached to the boat, the boat operator can manually release the boat hook and the flexible catch from the mooring line and reattach the handle so that the buoy arrester is ready for use in the future along with the boat hook securing line together.

The instant invention has been shown and described herein in what is considered to be the most practical and preferred embodiment. It is recognized, however, that departures may be made there from within the scope of the invention and that obvious modifications will occur to a person skilled in the art.

What I claim is:

1. A buoy arrestor to aid a boater to attach a mooring buoy line to a boat and initial arrestment of the mooring buoy comprising:

a mooring attachment line hook body having a rigid metal rod body including a first linear segment having a proximal end, a second mid curved segment that is U-shaped and a third linear segment parallel to said first linear segment and in a common plane with said second curved U-shaped segment, said third linear segment forming a U-shaped passage sized to receive a mooring buoy attachment line, said hook body having a fourth linear segment joined at one end to said third linear segment and having a distal end forming an end of the hook body, said fourth linear segment being at an acute angle relative to said first linear segment and disposed in said common plane with said first linear segment, said second curved U-shaped segment, and said third linear segment;

said hook body having a retrieving mooring buoy line attachment eye formed by a metal rod attached to said first linear segment and protruding towards said third linear segment, and said hook body eye mounted in said common plane with said first, third, and fourth linear segments and said second curved U-shaped segment;

said hook body eye protruding into the mooring buoy attachment line receiving passage formed by the hook body;

a cylindrical hook body base member having a top end surface and a bottom end surface, said base member top end surface attached to said first linear segment proximal end;

a flexible catch formed in an elongated U-shaped catch body having first and second ends, said flexible catch body first and second ends firmly attached to said hook body base cylindrical first end and said proximal end of said hook body first linear segment;

said flexible catch body including first and second parallel segments terminating in said flexible catch body first and second ends;

said flexible catch body first and second parallel segments being curved but parallel in the same curved plane and disposed across the passage opening formed by said hook body first and third linear segments;

said flexible catch body having a stable closed position across said body passage opening and movable toward the second curved U-shaped hook body segment to allow the entrance of a mooring buoy attachment line into said hook body passage;

said flexible catch body having a stable closed position across said hook body passage opening and not movable in a direction away from said second curved U-shaped hook body segment in its stable closed position, whereby a mooring attachment line disposed in said hook body passage is secured by said flexible catch in said hook body passage.

2. A device as in claim 1, including:

an elongated straight rigid pole having a first end and a second end, said poll first end including a female cylindrical connector size to fit and detachably connected to said hook body base cylinder second end.

3. A device as in claim 1 including:

a hook body retaining line having a first end and a second end, said hook body retaining line first end attached to said hook body for securing said hook body during mooring operations.

* * * * *